US005792393A

United States Patent [19]

Smirnoff

[11] Patent Number: 5,792,393

[45] Date of Patent: Aug. 11, 1998

[54] METHOD OF REPAIRING HOT REFRACTORY LININGS IN HIGH-TEMPERATURE VESSELS

[75] Inventor: Richard M. Smirnoff, Ranchos Palos Verdes, Calif.

[73] Assignee: Atlantic Richfield Company, Los Angeles, Calif.

[21] Appl. No.: 824,764

[22] Filed: Mar. 25, 1997

[51] Int. Cl.[6] ..... F27D 1/16

[52] U.S. Cl. ..... 264/30; 264/36; 264/69

[58] Field of Search ..... 264/30, 69, 36

[56] References Cited

U.S. PATENT DOCUMENTS

| | | | |
|---|---|---|---|
| 4,017,960 | 4/1977 | Kawabe | 264/30 |
| 4,436,678 | 3/1984 | Nishikawa et al. | 264/30 |
| 4,465,648 | 8/1984 | Kiriyama et al. | 264/30 |

FOREIGN PATENT DOCUMENTS

| | | | |
|---|---|---|---|
| 51-21363 | 7/1976 | Japan | 264/30 |
| 57-51208 | 3/1982 | Japan | 264/30 |

OTHER PUBLICATIONS

Thermbond® Refractories Product Information (18 pages), Stellar Materials, Inc.

Premier Cer-Wool® Pumpable HT Insulation Product Data Sheet.

Premier Cer-Wool® Pumpable CE Insulation Product Data Sheet.

Premier Cer-Wool® Pumpable AR Insulation Product Data Sheet.

Premier Cer-Wool® Insulation Product Data Sheet.

ThermalCeramics Cease-Fire® 2000 Insulating Foam Product Information Sheet (2 pages).

ThermalCeramics Cease-Fire® Fast Aide Kits Product Information Sheet.

ThermalCeramics Cease-Fire® 200 Pump Product Information Sheet.

ThermalCeramics Cease-Fire® 100 Pump Product Information Sheet (2 pages).

*Primary Examiner*—James Derrington

*Attorney, Agent, or Firm*—Sheldon & Mak, Inc.

[57] ABSTRACT

A method of repairing damaged hot refractory linings in high-temperature vessels includes forming an opening through the outer shell of the vessel proximate to the damaged region of the hot refractory lining, and introducing a refractory material into the damaged region. The refractory material is rapidly injected in a sufficient amount to effect complete filling, and is fast curing to strength at the operating temperature of the vessel. The method eliminates the need to allow the vessel to cool down to ambient temperature and then reheat the vessel to operating temperature thereby eliminating thermal cycling of the refractory lining.

15 Claims, 3 Drawing Sheets

METHOD OF REPAIRING HOT REFRACTORY LININGS IN HIGH-TEMPERATURE VESSELS

BACKGROUND

The invention is directed to refractory lined high-temperature vessels and, more particularly, to a method of repairing refractory linings in stationary and rotary high-temperature vessels in the hot condition.

Refractory lined rotary and stationery vessels are widely used in systems to process materials at high temperatures. For example, rotary kilns are used in rotary calciner systems for carbonaceous materials such as coal, petroleum coke and coal tar pitch coke, and in cement and limestone processing systems.

During petroleum coke calcining, coke is thermally treated to remove moisture and volatile combustion matter, and to improve its physical properties. The processing temperature in the rotary kiln typically ranges from about 1400° F. –2000° F. at the feed end to about 2300° F. –2700° F. at the firing end. In the hot zone, the temperature is typically about 3000° F.

Rotary kilns have an elongated cylindrical structure and include a metal outer shell and a refractory lining that defines the material processing chamber. The refractory lining is typically formed of refractory bricks having high temperature resistance and insulating ability. During material processing, the rotary kiln is rotated about a downwardly inclined longitudinal axis.

The high-temperature processing conditions in high-temperature vessels are severely demanding and cause refractory linings to frequently fail. A number of factors affect the wear and life of refractory linings. For rotary kilns, the most important of these factors is the frequency of rotary kiln stops and shutdowns. Generally, increasing shutdowns and rotary kiln stops shortens the life of the refractory lining.

The length of stops of the rotary kiln at the operating temperature is also very important. If the rotary kiln is stopped for too long of a period of time, convection can cause the upper portion of the rotary kiln to become much hotter than the bottom portion, resulting in bowing of the rotary kiln axis and the creation of large stresses in the refractory lining.

Another important factor that influences the life of the refractory lining is the cooling rate of the shell and refractory lining during shutdowns. The cooling rate must be closely controlled and the cooling must be uniform to control thermal stress development in the refractory lining.

Similarly, the heating rate of the refractory lining following shutdown also affects the life of the refractory. An overly high heating rate to temperature can cause thermal deterioration of the bricks.

The above-described heating and cooling effects are also detrimental to the life of refractory linings in high-temperature stationary vessels.

The thermal stresses and thermal shock caused by sudden variations in temperatures and thermal cycling of refractory linings can ultimately result in thermal fracturing and spalling of the bricks. The refractory lining can fail completely, or it can become so thin that the outer shell is essentially thermally unprotected.

Refractory bricks can fall away and leave the adjacent outer shell area no longer thermally insulated from the high temperature in the processing chamber. The outer shell is then directly exposed to the internal temperature of the vessel and can become red/orange hot. These areas in the outer shell are known as "hot spots." The refractory lining can be further damaged due to loosening of the periphery. Failure of the refractory lining is dangerous because the unprotected shell can become so badly warped that it must be entirely replaced at a high cost.

Once a damaged refractory lining is discovered, the rotary kiln is then shut down and cooled to near ambient temperature at which the refractory lining is repaired. Known repair procedures require about four to five days to shut down the rotary kiln, allow the rotary kiln to cool down to near ambient temperature, repair the refractory lining, and then reheat the rotary kiln to the operating temperature. These procedures are unsatisfactory due to the loss of production and extra fuel costs to reheat the rotary kiln, associated with the lengthy discontinuance in the operation of the rotary kiln.

Thus, there is a need for a method of repairing refractory linings in stationary and rotary high-temperature vessels that (i) can be performed at the operating temperature of the vessel, thereby eliminating thermal cycling of the refractory lining and reducing down time of the vessel; (ii) is quickly performed to avoid damage to rotating vessels; (iii) enables refractory lining repair at substantially all sections of the vessel that are accessible from outside the vessel; and (iv) provides sufficient filling of the damaged area of the refractory lining to ensure a sound repair.

SUMMARY

The invention is directed to a method for repairing refractory linings in stationary and rotary high-temperature vessels that satisfies the above-described needs. The method (i) can be performed at the operating temperature of the vessel, thereby eliminating thermal cycling and associated thermally induced damage to the refractory lining, as well as reducing down time of the vessel; (ii) is quickly performed from outside of the vessel, enabling short operation delays for rotating vessels; (iii) enables refractory lining repair at substantially all sections of the vessel that are accessible from outside the vessel; (iv) provides sufficient filling of the damaged region of the refractory lining to ensure sound repairs; and (v) provides a repair that can withstand severe high-temperature environments such as in rotary kilns.

The present method of repairing a damaged region of a refractory lining in a high-temperature vessel having a shell surrounding the refractory lining, includes the steps of forming a hole through the shell proximate to the damaged region of the refractory lining, introducing a refractory material through the hole and into the damaged region, and then closing the hole.

According to the present invention, the refractory lining does not have to be cooled to ambient temperature to conduct the repair. The refractory lining can be repaired at temperatures ranging from about 250° F. to about 3000° F. Desirably, the refractory lining is repaired at the operating temperature of the high-temperature vessel, which is typically at least about 1000° F. and can range to at least 3000° F. Accordingly, there is no need to allow the vessel to cool down to near ambient temperature and then reheat the vessel to the operating temperature following the repair. Thus, the present invention avoids the detrimental effects associated with thermal cycling of refractory linings. The high-temperature vessel can be a stationary vessel or a rotary vessel. The present method can typically be performed in a total of less than about 1 hour, making it particularly advantageous for use in rotary kilns, where such short repair times are highly advantageous.

The refractory material is preferably a phosphate bonded castable refractory material. This material (i) can be induced with a sufficient fluidity at about ambient temperature to be injected into the damaged region of the refractory lining; (ii) typically cures within less than about 15 min at the operating temperature of the vessel; (iii) has sufficient thermal stability to be heated from ambient temperature to the operating temperature by injection into the vessel without explosive failure; and (iv) provides satisfactory strength and wear resistance at high temperatures in severe environments such as rotary kilns.

A sufficient amount of the refractory material to effect a repair can be rapidly introduced into the damaged region of the hot refractory lining. Typically, the damaged region can be substantially filled in less than about 2 min. This rapid introduction of the refractory material prevents premature setting from occurring.

The refractory material is preferably vibrated during and after introduction into the damaged region of the refractory lining to enhance filling.

BRIEF DESCRIPTION OF THE DRAWINGS

These and other features, aspects and advantages of the present invention will become better understood from the following drawings, description and appended claims, where:

DESCRIPTION

Figure 1:
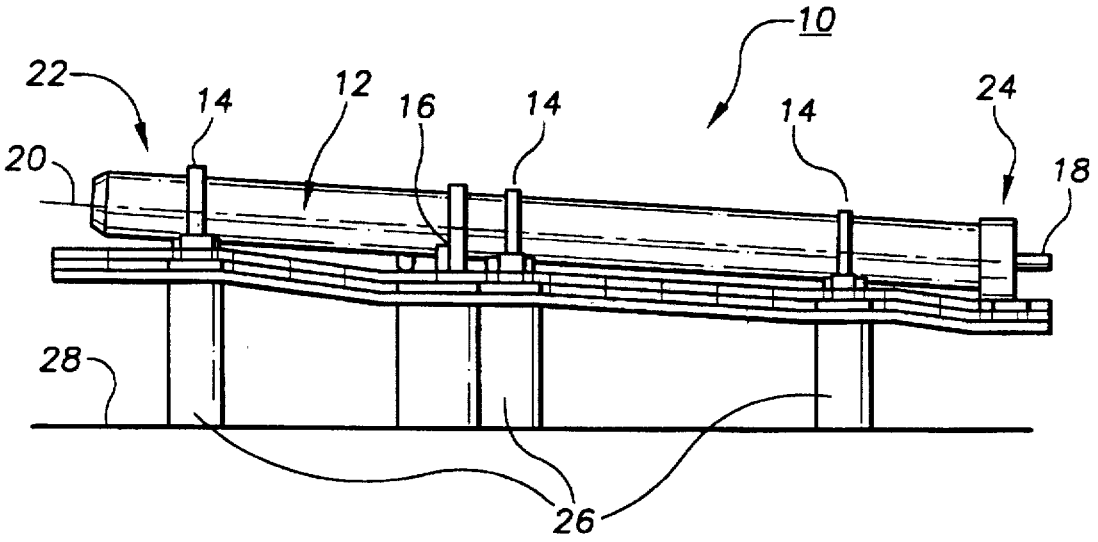
FIG. 1 is a side elevation view of a conventional rotary kiln.

The invention is directed to a method for repairing refractory linings in high-temperature vessels. The present method is described herein with reference to use in a conventional rotary kiln 10 illustrated in FIG. 1. The present invention can alternately be used to repair refractory linings in various other high temperature vessels including other types of rotating vessels and stationary vessels. For example, the present invention can be used to repair hot refractory linings in rotary hearths, boilers, furnaces and reactors. As used herein, the term "high temperature vessel" means a vessel that normally operates at a temperature above about 1000° F. Below this temperature, refractory linings are generally not utilized in vessels.

According to the present invention, the refractory lining does not have to be cooled down to ambient temperature prior to conducting the repair. The refractory lining can be repaired at temperatures ranging from about 250° F. to at least about 3000° F. Desirably, the refractory lining is repaired at the operating temperature of the high-temperature vessel, which is typically from about 1000° F. to at least 3000° F. In rotary kilns, for example, the temperature of the refractory lining can vary at different locations of the vessel.

The illustrated rotary kiln 10 includes a cylindrical vessel 12, a plurality of raised rings supported on rollers 14, a drive 16 and a burner 18. The vessel 12 can be rotated either clockwise or counterclockwise (as referenced with respect to an uphill or downhill direction) about a downwardly inclined longitudinal axis 20 to transport material between the feed end 22 and the discharge end 24 of the vessel 12. The rotary kiln 10 is supported on a plurality of upstanding support members 26 above a surface 28.

The vessel 12 is heated by combustion of fuel at the burner 18. During coke processing, the vessel 12 is also heated by the combustion of volatile hydrocarbon compounds that evolve from the green coke feed.

Figure 2:
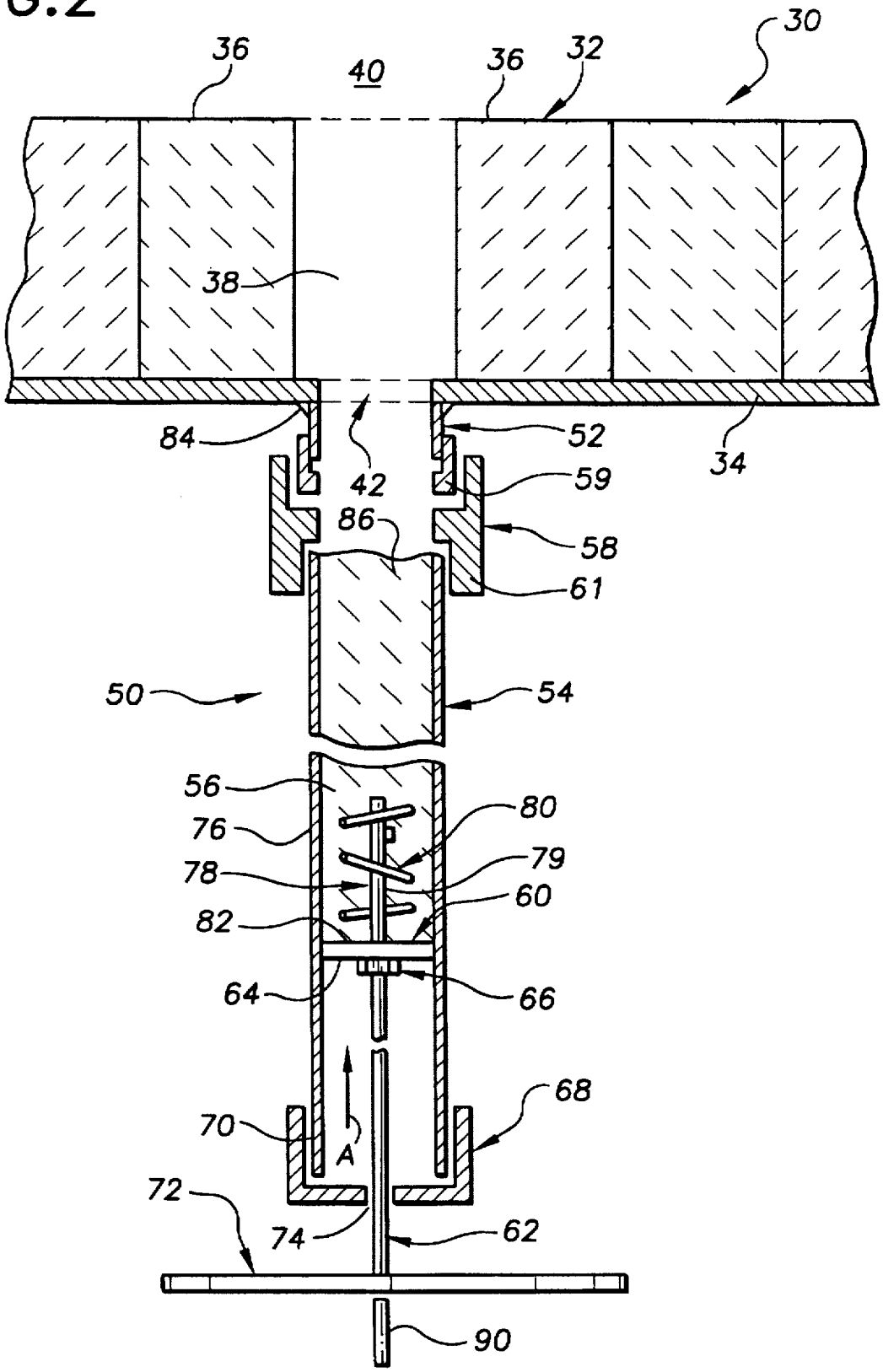
FIG. 2 is a partial cross-sectional view of a vessel having a damaged region in the refractory lining and an apparatus for practicing the method of repairing the damaged refractory lining according to the present invention, before introducing refractory material into the damaged region.
Figure 3:
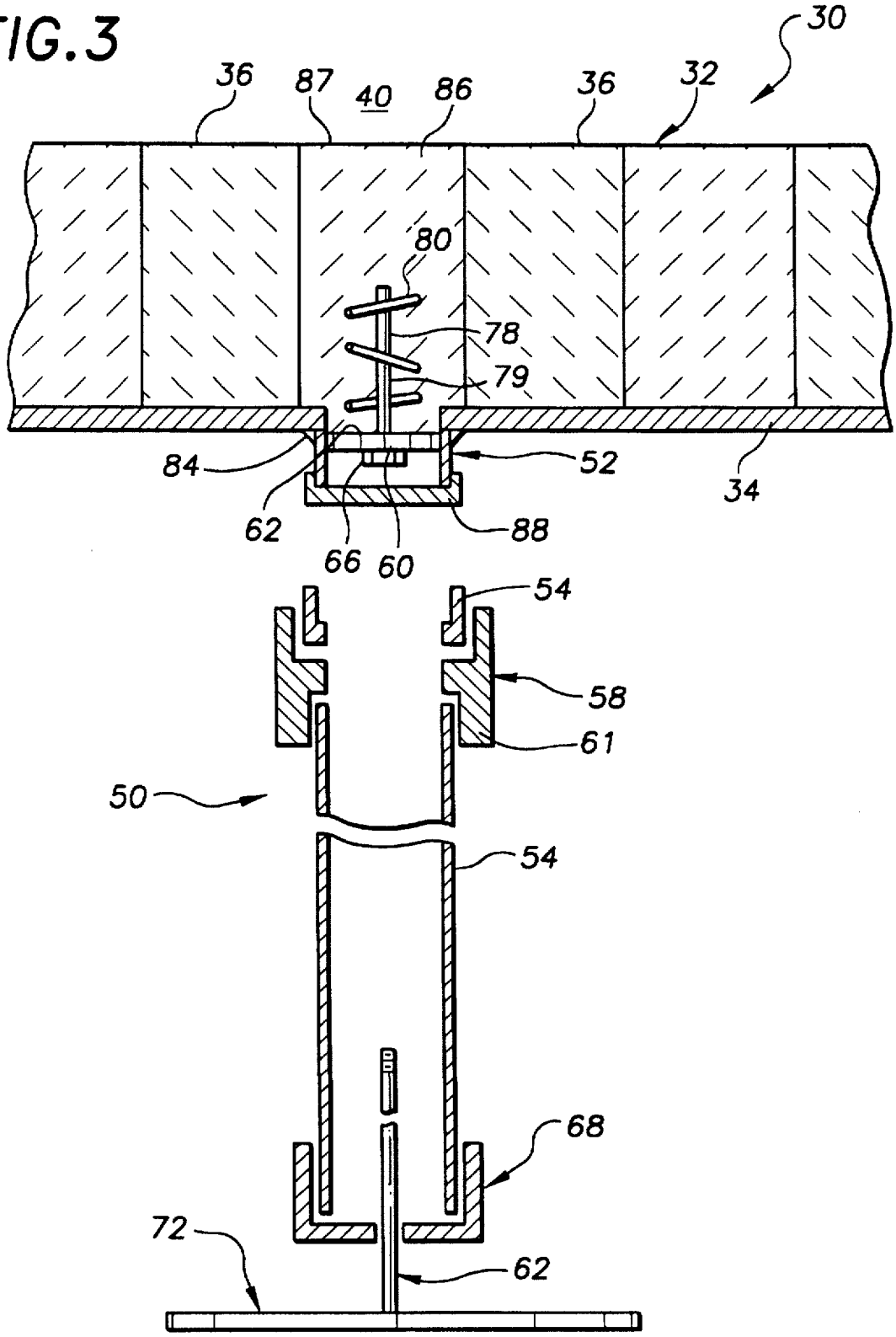
FIG. 3 is a partial cross-sectional view of the repaired condition of the refractory lining.

FIGS. 2 and 3 illustrate the wall 30 of the vessel 12 of the rotary kiln 10 and an apparatus 50 suitable for practicing the present method. The wall 30 includes a refractory lining 32 and a shell 34 surrounding the refractory lining 32. The refractory lining 32 is typically formed of a plurality of refractory bricks 36 composed of fireclay, mullite and the like. The shell 34 is typically formed of a metal such as structural grade carbon steel. A damaged region 38 in the form of a missing brick is shown between the bricks 36. The damaged region 38 is in communication with the processing chamber 40 of the vessel 12. The damaged region can be a larger region defined by a plurality of missing or damaged bricks.

Other types of refractory linings such as continuous linings are used in high-temperature vessels and can be repaired using the present method. These linings are commonly known as monolithic linings and include castable and plastic monolithic linings. Castable monolithic linings are typically composed of calcium aluminate cement bonded aggregate materials. The aggregates are typically compounds of alumina and silica. Additional aggregates used in smaller proportions include silicon carbide, zirconia and magnesia. Plastic monolithic linings are either clay or phosphate bonded and include the same types of aggregates as the castable linings. Both types of plastic monolithic linings require elevated temperatures to effect setting or hardening into a solid.

At the operating temperature of the rotary kiln 10, the damaged region 38 in the refractory lining 32 can result in a "hot spot" developing in the outer shell 34 adjacent to the damaged region 38. Hot spots have a red/orange hot appearance and can be detected visually, or using an instrument such as an optical pyrometer that measures the temperature of the shell 34, from outside the vessel 12.

According to the present invention, a hole 42 is formed through the shell 34 at the hot spot to access the damaged region 38 of the refractory lining 32 from outside of the vessel 12. The hole 42 is sized such that a plunger 60 contacts opposed surfaces that form the hole 42 as shown in FIG. 3 and described in greater detail below. For rotating vessels such as the rotary kiln 10, rotation is stopped before the repair is performed. Typically, the rotary kiln 10 is stopped at a point in its rotation such that the hot spot is located at about the 10:00 position and faces away from the surface 28.

The hole 42 is then formed in the shell 34. Typically, the hole 42 is formed using a cutting torch, an electric arc gouger or the like that can quickly form the hole 42. For each of the steps of the present method, it is important to complete the step as expeditiously as possible to minimize the amount of time the rotation of the rotary kiln 10 is stopped to avoid damage to the refractory lining 32 and the shell 34.

The apparatus 50 includes a cylinder 54 having a chamber 56, the plunger 60 which is received in the chamber 56, an elongated rod 62 fastened to a rear face 64 of the plunger 60 by a fastener 66, a cap 68 secured to the rear end 70 of the cylinder 54, and a handle 72 secured to the rod 62. The handle 72 is rotated relative to the fastener 66 to disconnect the rod 62 from the plunger 60. The rod 62 extends through a hole 74 in the cap 68 and into the chamber 56. Forward and rearward movement of the rod 62 moves the plunger 60 in the chamber 56. The plunger 60 preferably is sized so as to form a close fit with the wall 76 of the cylinder 54. The size of the cylinder 54 and the plunger 60 can be varied to change the volume of the chamber 56. Typically, the chamber 56 has a volume of from about 1–2 gal. As described in greater detail below, a vibratory device 78 including an upstanding rod 79 and a plurality of rod members 80 attached to the upstanding rod 79 extends from the front face 82 of the plunger 60.

After the hole 42 is formed through the shell 34, the vessel 12 is typically rotated so that the hole 42 faces the surface 28, to enable the repair to be performed from directly below the rotary kiln 10. A refractory material 86 for introducing into the damaged region 38 of the refractory lining 32 is poured into the chamber 56 between the connector 58 and the plunger 60. The apparatus 50 is then moved close to the shell 34 such that the chamber 56 is in communication with the hole 42. A connecting piece such as a section of pipe 52 is typically secured to the shell 34. The pipe 52 can be secured by a weld 84 to withstand high temperatures.

The apparatus 50 is typically releasably secured to the shell 34. A connector 58, including an inner portion 59 and an outer portion 61, couples the pipe 52 to the cylinder 54. The connector 58 is preferably a quick-disconnect threaded coupling attached to the cylinder 54 that can be quickly coupled to and disconnected from the pipe 52. The pipe 52 can be externally threaded to attach to the connector 58.

The vessel 12 is typically then rotated such that the pipe 52 faces the surface 28. The refractory material 86 can then be introduced into the damaged region 38. The amount of the refractory material 86 poured into the chamber 56 of the cylinder 54 is estimated to equal at least the amount required to sufficiently fill the damaged region 38 of the refractory lining 32 so that only a single injection of the refractory material 86 is needed. The plunger 60 is then moved forward as represented by arrow A to inject the refractory material 86 into the damaged region 38. At the full extent of forward movement of the plunger 60, the front face 82 of the plunger 60 abuts the outer shell 34 and the vibratory device 78 is partially received between the adjacent bricks 36 of the refractory lining 32 as shown in FIG. 3. The length of the vibratory device 78 can be varied so that it extends further inside of the wall than shown.

FIG. 3 illustrates the refractory material 86 after injection, filling the space between the bricks 36. As shown, the plunger 60 and vibratory device 78 are unfastened from the rod 62 and left embedded within the refractory material 86 to become a permanent part of the repaired region. The vibratory device 78 acts as a reinforcing structure to reinforce the cured refractory material 86. The vibratory device 78 is formed of metal such as stainless steel that can withstand the high temperatures in the vessel 12.

The refractory material 86 is typically injected upwardly to repair rotary kilns. This upward filling provides the advantage that once the refractory material 86 is placed in the damaged region 38, the refractory material 86 settles under it own weight, enhancing filling of the damaged region 38 and ensuring a sound repair.

The plunger 60 is preferably moved forward using a vibrator 90 applied to the handle 72. The vibrator 90 can be, for example, a pencil-type vibrator commonly used to vibrate concrete. The vibration fluidizes the refractory material 86 and reduces the possibility of it prematurely setting before being injected into the damaged region 38. The vibratory device 78 and the plunger 60 effectively transmit vibration to further enhance fluidization so as to ensure that refractory material 86 sufficiently flows into and fills the damaged region 38. This is an important advantage as the refractory material 86 is stiff as mixed.

Once the plunger 60 is moved fully forward such that it contacts the outer shell 34, the plunger 60 is maintained at this position for a sufficient amount of time for the refractory material 86 to set. The vibrator 90 is preferably operated to vibrate the refractory material 86 to prevent a crust from forming on the refractory material 86 and to ensure the refractory material 86 takes the shape of the damaged region 38. Typically, the plunger 60 is maintained in this position for about 15 min and vibration is continued for no more than about 1 min after the plunger 60 is placed in the fully forward position. This amount of time is typically sufficient for the refractory material 86 to develop sufficient strength to re-start rotation of the vessel 12.

After sufficient setting of the refractory material 86, the connector 58 is disconnected from the pipe 52 and the cylinder 54 is moved away from the vessel 12. The vessel 12 is typically then rotated such that the pipe 52 is located at about the 10:00 or 2:00 position. The plunger 60 is preferably then fixedly attached to the outer shell 34 and to the pipe 52, typically by welding. The plunger 60 acts as a hole occluding structure to cover the hole 42. A cap 88 is typically then fastened to the pipe 52 to close the opening 42. Rotating the vessel 12 before capping the hole 42 minimizes the amount of time the vessel 12 is maintained in one position so as to minimize convection effects.

In instances in which the damaged region 38 of the refractory lining 32 is large, more than one apparatus 50 can be used for repair. The refractory material 86 is preferably injected approximately simultaneously by the apparatuses 50 to ensure that setting occurs at about the same time throughout the damaged region 38 to achieve a sound repair. This is advantageous because the setting time of the refractory material 86 generally decreases as its volume increases.

In accordance with the present invention, the refractory material 86 is preferably a phosphate bonded castable refractory material. An excellent refractory material is "THERMBOND" Formula Five-A, commercially available from Stellar Materials Inc. of Detroit, Mich. This refractory material has a typical chemical analysis of 86% $A1_2O_3$, 6% $P_2O_5$ and 8% other components. The formulation includes a dry component and a wet liquid component that are mixed together and then quickly poured into the chamber 56.

Phosphate bonded castable refractory materials provide several important characteristics making them excellent materials for repairing hot refractory linings. These materials are fast curing to a satisfactory strength level, and bond to existing refractory lining materials. In addition, these materials can be introduced into the refractory lining at a wide range of temperatures ranging from about 250° F. to at least about 3000° F. Generally, the cure or set-up time for these refractory materials decreases as the refractory lining 32 temperature increases. The inner surface 87 directly exposed to the heat of the processing chamber 40 typically sets up in about 1 min at operating temperatures typically between about 1000° F. to about 3000° F., normally reached in rotary kilns. The refractory material outward from the surface 87 takes longer to set up, typically from about 10 min to about 15 min at the operating temperature. The set-up time of the core refractory material 86 increases as the volume of the material increases.

The fast curing rate of phosphate bonded castable refractory materials is highly advantageous in the repair of hot refractory linings and, particularly, hot refractory linings in rotary kilns in which fast curing enables short repair times at the operating temperature. Rotary kilns can be damaged by excessively long stops at the operating temperature. The rotation axis can become warped, causing damage to the refractory lining once rotation is re-started. The fast curing provided by phosphate bonded castable refractory materials overcomes this problem by enabling repair of damaged regions in hot refractory linings before such warpage can occur. Typically, phosphate bonded castable refractory materials achieve sufficient strength within from about 10 min to about 15 min after injection into the damaged region 38 to enable rotation of the vessel 12 to be restarted. These materials have no upper limit on how long they can be held stationary after injection before restarting rotation of the kiln, other than any time constraints imposed by the kiln itself. For rotary kilns, the total time to perform the present method, from stopping rotation of the rotary kiln to restarting rotation, is typically less than about 1 hour. For stationary vessels, the total time from beginning to completing the repair is also less than about 1 hour. Additional welding and inspection requirements may be applicable for some vessels, that can increase the total repair time. In addition, the capability of repairing the rotary kiln at the operating temperature avoids the need to thermal cycle the refractory lining, thereby prolonging the life of the refractory lining.

Phosphate bonded castable refractory materials also have sufficient high-temperature density, structural strength and thermal stability to withstand the severe conditions of rotary kilns. "THERMBOND" Formula Five-A has a bulk density after cure of about 175 lb/ft$^3$, a compressive or cold crush strength of about 10,000 psi at 2500° F., and a cold modulus of rupture of more than 2000 psi at 2500° F. The cold crush strength and the cold modulus of rupture are determined in accordance with ASTM Standard No. C133 (1994). These materials also have sufficient resistance at high temperatures to abrasive action resulting from the sliding kiln feed bed and dust entrained in the gas stream. "THERMBOND" Formula Five-A has an abrasion loss value of 6.2 cm$^3$ loss at 1500° F. Abrasion loss is determined in accordance with ASTM Standard No. C704 (1994).

Phosphate bonded castable refractory materials can also be introduced into damaged regions of refractory linings in quantities to effect sufficient filing of the damaged region 38 in short amounts of time. These materials can be supplied via supply conduits having a diameter significantly greater than refractory material supply conduits such as hoses. A sufficient amount of phosphate bonded castable refractory materials to substantially fill the damaged region can typically be introduced in a single injection of the plunger 60. These materials can be injected at a rate of from about 1–2 gal/min using the plunger 60 with a chamber 56 diameter of about 4 in. A volume of refractory material of from about 1 gal to about 2 gal is typically sufficient to substantially fill the damaged region 38 of the refractory lining 32. The chamber 56 can be sized to contain at least this volume of material to enable substantially complete filling of the damaged region 38 in a single injection in from about 1–2 min.

Rapid introduction of the refractory material 86 reduces the possibility of it prematurely setting before all of the refractory material is introduced into the hot damaged region 38. Such setting can prevent adequate filling of the refractory material into the damaged region, resulting in voids and other like defects in the refractory material and insufficient insulating of the outer shell 34. Phosphate bonded castable refractory materials do not have the disadvantages of pumpable refractory materials, which are primarily cement-based. Cement-based materials are hydraulic-setting and undergo a hydration reaction at a narrow elevated temperature range to set. After this reaction is completed, water must be released slowly to avoid the generation of high internal pressure in the materials, which can cause the materials to fail in a sudden and catastrophic manner known as explosive spalling. It would not be possible to achieve this slow water release in a hot refractory lining environment due to the extremely high heating rate the materials would be subjected to. As a result, an effective bond holding the aggregate material would not form throughout the refractory. Virtually all cement based pumpable materials require a 24 hr. cure time, followed by a slow, controlled heat up to effect drying, typically lasting from 24–60 hr.

It is envisioned that other refractory materials than phosphate bonded castable refractory materials can optionally be used in the present invention. Such other refractory materials preferably have (i) sufficient fluidity at about ambient temperature to be injected into the damaged region; (ii) a curing rate sufficient to set up to a hard texture within approximately 15 min after injection at the temperature of the hot refractory lining, and (iii) sufficient thermal stability to be heated from ambient temperature to the operating temperature by injection into the vessel without explosive failure, and have a volume change of less than about 1½%, measured as permanent linear change in accordance with ASTM Standard No. C113 (1993), so as to be substantially unaffected by high and low temperatures and large temperature changes. The materials would preferably also have a crush strength of at least about 5000 psi at temperatures up to about 2500° F., and a density approximating that of the surrounding refractory lining, which is typically at least about 150 lb/ft$^3$. For vessels in which abrasion of the refractory lining is not as much of a concern as in rotary kilns, a lower crush strength of at least about 3000 psi can be sufficient.

As used herein, the term "sufficient fluidity" means that the refractory material is sufficiently viscous to be injected into the vessel. Viscosity in refractory materials is measured in empirical terms, such as "ball in hand." A ball of the refractory is mixed and then tossed into the air and made to land in the palm of the hand. If the refractory gently forms around the fingers but does not run between them, it is considered satisfactory. If the refractory runs between the fingers, it is too wet. If the refractory breaks apart, it is too dry.

Phosphate bonded castable refractory materials have a viscosity approximating the ball in hand consistency. This viscosity is maintained at high temperatures. Refractory materials that are formulated to be pumped do not maintain such sufficient fluidity at high temperatures. Accordingly, pumpable refractory materials are unsuitable to be injected into vessels at high temperatures.

For the repair of stationary vessels, the refractory material preferably has sufficient viscosity and a suitable curing rate so that it does not flow out of the damaged region before curing occurs. Phosphate bonded castable refractory materials have such a viscosity and curing rate.

Thus, the present method of repairing damaged regions in hot refractory linings in high-temperature vessels provides a number of important advantages. The method can be used to repair various types of high-temperature vessels including both stationary and rotary vessels. The method eliminates the need for complete operation shut-downs.

The method can be performed from outside the vessel at the vessel's operating temperature. This eliminates the need for thermal cycling of the refractory lining. The method is quickly performed, thereby enabling short breaks in the vessel operation for rotary vessels. The elimination of shutdowns and the use of short stops maximize the life of the refractory lining. Furthermore, the method reduces down time of the vessel and avoids the additional fuel requirements for reheating the vessel to the operating temperature.

In addition, the present method enables more sections of the hot refractory lining to be accessed from outside the vessel than is possible using known repair methods. The present method is easy and inexpensive to perform and provides for sound repairs of damaged refractory linings.

Although the present invention has been described in considerable detail with reference to certain preferred versions thereof, other versions are possible. Therefore, the scope of the appended claims should not be limited to the description of the preferred versions contained herein.

What is claimed is:

1. A method of repairing a region of a refractory lining in a high-temperature vessel having a shell surrounding the refractory lining, the method comprising the steps of:

a) forming a hole through the shell in communication with the region of the refractory lining;

b) providing a phosphate bonded castable refractory material having a crush strength of at least about 5000 psi;

c) injecting the refractory material through the hole and into the region;

d) vibrating the refractory material during the step of injecting and after being injected into the region of the refractory lining, in order to enhance fluidization of the refractory material; and e) closing the hole.

2. The method of claim 1, wherein the refractory material has a density of at least about 150 lb/ft$^3$ at the refractory lining temperature.

3. The method of claim 1, wherein the vessel is a rotary kiln, and the refractory material has a curing time of less than about 15 min at the high temperature.

4. The method of claim 3, wherein the step of injecting comprises:

a) providing an apparatus comprising a housing having a chamber and a plunger slidably received within the chamber; and b) placing the refractory material into the chamber, positioning the chamber in communication with the region of the refractory lining, and sliding the plunger within the chamber to inject the refractory material into the region of the refractory lining.

5. The method of claim 4, wherein the vibrating step further comprises vibrating the refractory material (i) after being placed in the chamber, and (ii) as it is being injected into the region of the refractory lining, in order to enhance fluidization of the refractory material.

6. The method of claim 1, wherein the refractory lining defines a processing chamber, and the refractory material is exposed directly to the processing chamber environment.

7. The method of claim 6, wherein the vessel is a rotary kiln, and the refractory material is exposed to a temperature of from about 250° F. to about 3000° F.

8. The method of claim 1, wherein the refractory lining is at a temperature of from about 250° F. to at least about 3000° F.

9. The method of claim 1, wherein the refractory material is injected into the region of the refractory lining at a rate of at least about 1 gal/min.

10. The method of claim 3, wherein the method further comprises before the step of forming, stopping rotation of the rotary kiln, and after the step of closing, re-starting rotation of the rotary kiln.

11. A method of repairing a damaged region of a refractory lining in a rotary kiln having a shell surrounding the refractory lining, the method comprising the steps of:

a) stopping rotation of the rotary kiln;

b) forming from outside the rotary kiln a hole through the shell in communication with the damaged region of the hot refractory lining, the refractory lining being at an operating temperature of at least about 250° F.;

c) introducing through the hole and into the damaged region a phosphate bonded castable refractory material having a crush strength of at least about 5000 psi at the operating temperature, the refractory material being introduced at a rate of at least about 1 gal/min;

d) vibrating the refractory material during the step of introducing and after the refractory material is introduced into the damaged region, in order to enhance fluidization of the refractory material;

e) closing the hole; and f) re-starting rotation of the rotary kiln within less than about 15 min after the step of introducing.

12. A method of repairing a region of a refractory lining at a temperature of at least about 250° F. in a high-temperature vessel, the method comprising the steps of:

introducing into the region a refractory material having, (i) sufficient fluidity at about ambient temperature to be injected into the region;

(ii) sufficient thermal stability to be heated from ambient temperature to the high temperature by injection into the vessel without explosive failure; and, (iii) a crush strength of at least about 5000 psi at the refractory lining temperature;

providing an apparatus comprising a housing having a chamber and a plunger slidably received within the chamber; and, placing the refractory material into the chamber, positioning the chamber in communication with the region of the refractory lining, and sliding the plunger within the chamber to inject the refractory material into the region of the refractory lining.

13. The method of claim 12, wherein the refractory material is introduced into the region of the refractory lining at a rate of at least about 1 gal/min.

14. The method of claim 12, wherein the refractory material is a phosphate bonded castable refractory material.

15. A method of repairing a region of a refractory lining at a temperature of at least about 250° F. in a high-temperature vessel, the method comprising the steps of:

introducing into the region a refractory material having, (i) sufficient fluidity at about ambient temperature to be injected into the region;

(ii) sufficient thermal stability to be heated from ambient temperature to the high temperature by injection into the vessel without explosive failure; and, (iii) a crush strength of at least about 5000 psi at the refractory lining temperature;

providing an apparatus comprising a housing having a chamber and a plunger slidably received within the chamber;

placing the refractory material into the chamber, positioning the chamber in communication with the region of the refractory lining, and sliding the plunger within the chamber to inject the refractory material into the region of the refractory lining; and, vibrating the refractory material (i) after being placed in the chamber, and (ii) as it is being injected into the region of the refractory lining.

* * * * *